United States Patent [19]

Gaebel

[11] Patent Number: 4,622,984

[45] Date of Patent: Nov. 18, 1986

[54] TOOTHBRUSH

[76] Inventor: Gary R. Gaebel, Box 2, Murdock, Nebr. 68407

[21] Appl. No.: 596,674

[22] Filed: Apr. 4, 1984

[51] Int. Cl.[4] ..... A45D 44/18

[52] U.S. Cl. ..... 132/84 R; 401/175

[58] Field of Search ..... 401/152, 155, 169, 180, 401/279, 175; 132/84 R

[56] References Cited

U.S. PATENT DOCUMENTS

| | | | |
|---|---|---|---|
| 993,006 | 5/1911 | Weinstein . | |
| 1,340,043 | 5/1920 | Grace . | |
| 2,172,624 | 9/1939 | Robert . | |
| 2,243,774 | 5/1941 | Resh . | |
| 2,521,928 | 9/1953 | Martin . | |
| 2,699,889 | 1/1955 | Johnson | 401/175 X |
| 4,269,207 | 5/1981 | Konrad et al. | 401/175 |
| 4,421,433 | 12/1983 | Villanueva | 401/175 |

*Primary Examiner*—Robert Peshock

*Attorney, Agent, or Firm*—E. Robert Newman

[57] ABSTRACT

A toothbrush with a paste-carrying hollow handle and a hand-manipulated dispensing apparatus including a threaded open end of the handle for connection with a container of toothpaste during loading, and connection with the bristle portion during operation. Also included in the handle is a quantity indicator window and a threaded plunger upon a shaft with mating threads, the plunger adapted to be advanced by hand-manipulated rotation of the shaft. A thumb-operated retractable gate is used to control the amount of paste dispensed through an opening located between the bristle rows, as well as to close off all dispensing.

6 Claims, 6 Drawing Figures

TOOTHBRUSH

TECHNICAL FIELD

The invention relates to novel and useful improvements in toothbrushes, and more particularly to brushes with toothpaste-containing handles in combination with hand-manipulated dispensing apparatuses.

BACKGROUND AND PRIOR ART

Toothbrushes have been the subject of myriads of improvements over the years to make them more convenient, more transportable, and more efficient for consumer use. Some of such improved toothbrushes have provided for a brush which will carry toothpaste inside the handle and which has a mechanism for forcing the paste onto or adjacent to the bristles.

Since the invention of the paste-carrying brush, improvements have been made in an attempt to provide a manner of sealing the unused paste from exposure during and after use of the brush. To date, the majority of such improvements provide a gate that is located such that a large amount of paste may still be exposed between the gate and the bristles. However, those known devices having structure for blocking the passage of the paste more proximate to the bristles do not provide a gate which can vary the rate of delivery.

In addition, the known prior art does not disclose a simple and clean method of loading paste into the handle. Along these same lines, the inventor is not aware of any prior art devices which provide any indication of when the handle will require more paste.

SUMMARY OF THE INVENTION

An object of the invention is to provide an improved toothbrush having a handle which is also a dispensable paste chamber.

Another object of the invention is to provide a toothbrush of the type hereinabove indicated having loading provisions for convenient and hygienic loading of the paste within the handle.

A further object is to provide a brush with a dispensing gate which provides for optimum protection of the remaining paste from exposure to air and water as well as the capacity to vary the amount of paste being dispensed.

Yet another object of the invention is the provision of a toothbrush of the type indicated which indicates when refill will be required.

A yet further object is to provide for more sanitary transportation of the toothbrush.

More generally, it is an object of the invention to provide a paste-carrying toothbrush which has few moving parts and which dispenses adjustable amounts of toothpaste onto its bristles in a simple and efficient manner. A retractable gate operates across an opening located between bristle rows which serves to close off all flow of paste as well as to control the amount being dispensed. A viewing window located near the bristle end of the handle allows one to observe the amount of contents remaining, and an air hole at the other end allows the handle to be quickly and easily loaded without a buildup of air pressure. The dispensing mechanism is operated by thumb-screw on the end of the handle away from the bristles, which directly acts upon a plunger within the handle.

These and other objects, advantages and novel features of the present invention will become apparent from the following detailed description of the invention when considered in conjunction with the accompanying drawings.

DESCRIPTION OF THE PREFERRED EMBODIMENT

Figure 1:
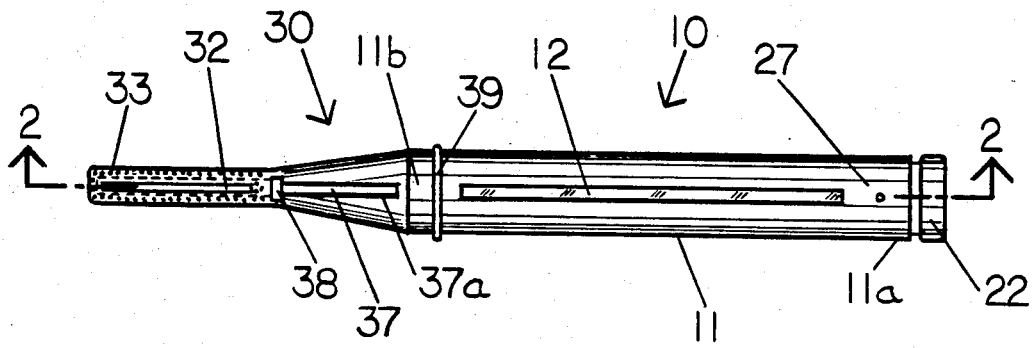
FIG. 1 is a top plan view of the device.
Figure 2:
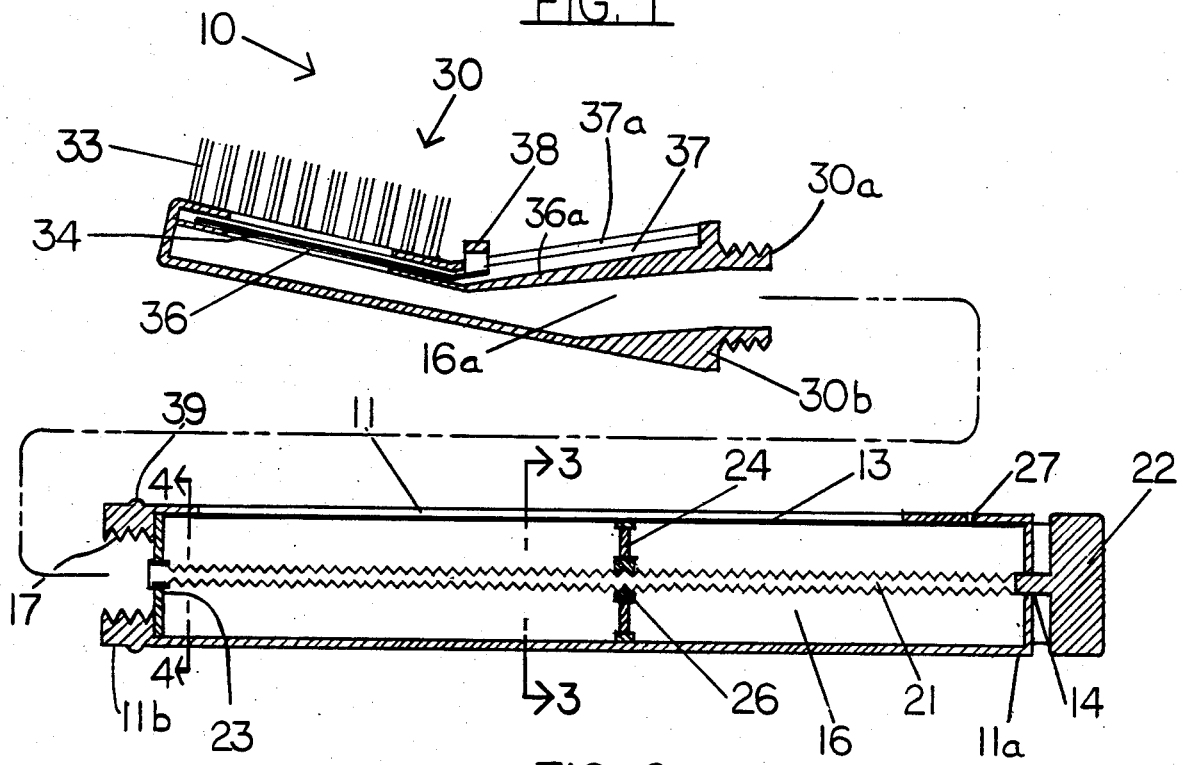
FIG. 2 is a partially exploded sectional view of the device, taken along line 2—2 in FIG. 1.

Referring now to the drawings, in which identical or corresponding parts are indicated by the same reference character throughout the several views and more particularly to FIG. 1, whereon the device is designated generally at 10, its major components are a handle (11), thumb-screw (22), and bristle portion (30). Referring now to FIG. 2, the handle (11) is generally cylindrical in shape and hollow, with a closed end **(11*a*), and an open, interiorly threaded end (11*b*). The threads (17) correspond with the threads of a toothpaste tube, as well as with the threaded end (30*a*) of the bristle portion (30) of the toothbrush (10). Obviously, the male and female threading of the preferred embodiment may be reversed for those toothpaste tubes with interiorly threaded dispensing nozzles. In the same way, it is contemplated that the bristle portion (30)** may be adapted to fasten directly to a toothpaste tube and the improvements used in that way.

A narrow slot (12) is cut in the upper side of the handle (11) and extends slightly less than end **(11*a*) to end (11*b*) (as seen in FIG. 1). A viewing window (13) of clear plastic, or other transparent material, is affixed within the handle (11), and is of such dimensions so as to cover the slot (12) completely. The window (13) is curved so as to lie flush against the inside surface of the handle (11) and project slightly inward therefrom. (See also FIG. 3**).

The closed end **(11*a*) of the handle has a small aperture (14) in its center, through which a shaft (21) will rotate. The shaft (21) extends from adjacent the threaded end (11*b*) of the handle (11), through the aperture (14), and slightly beyond the closed end (11*a*) of the handle (11), where it is rigidly affixed to the center of the thumb-screw (22). The shaft (21) is rotatably affixed at its other end at the center of a brace (23) (See also FIG. 4), such that rotation of the thumb-screw (22) will rotate the shaft (21). The brace will be described in more detail hereinafter. The thumb-screw (22) has a diameter the same as that of the outside diameter of the handle (11)**, and is of any convenient width.

Figure 3:
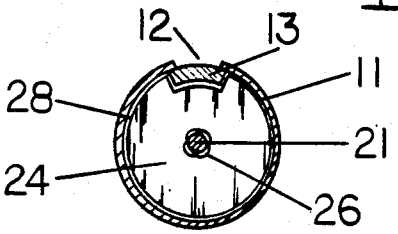
FIG. 3 is a sectional view of the device, taken along line 3—3 in FIG. 2.

A plunger (24), with an interiorly threaded aperture (26) corresponding with the shaft (21), is mounted upon said shaft (21) for movement within a chamber (16) in the handle (11). The plunger (24) is generally disc-shaped, but with a notch having the same shape as the cross-section of the window (13) cut along one edge (as seen in FIG. 3).

In operation, the plunger (24) will slide along the length of the chamber (16) with the window (13) acting as a guide rail, the plunger (24) being moved by rotation of the shaft (21) within the threaded aperture (26) of the plunger (24). Thus, rotation of the thumb-screw (22) will advance the plunger (24), such movement capable of being viewed through the window (13). It should be appreciated that the cementing effect of paste between plunger (24) and shaft (21) will be resisted due to the presence of window (13) within the notch of plunger (24).

Figure 4:
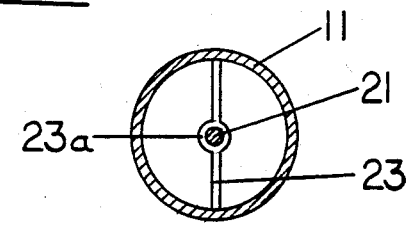
FIG. 4 is a sectional view of the device taken along line 4—4 in FIG. 2.
Figure 5:
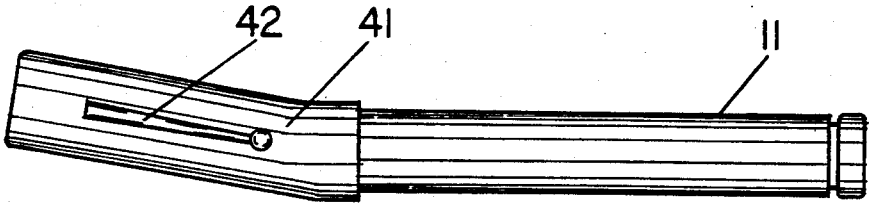
FIG. 5 is a side elevational view of the device with a cap installed upon one end.

Referring now to FIG. 4, the brace (23) is a narrow strip of rigid material across the diameter of the handle (11) and affixed at each end to the handle (11) walls. The center portion (23*a*) of the brace (23) is slightly enlarged to act as a bearing for the shaft (21). The brace (23) is affixed within the chamber (16) of the handle (11), adjacent the threads (17) of the threaded end (11*b*) (as seen in FIG. 2).

Figure 6:
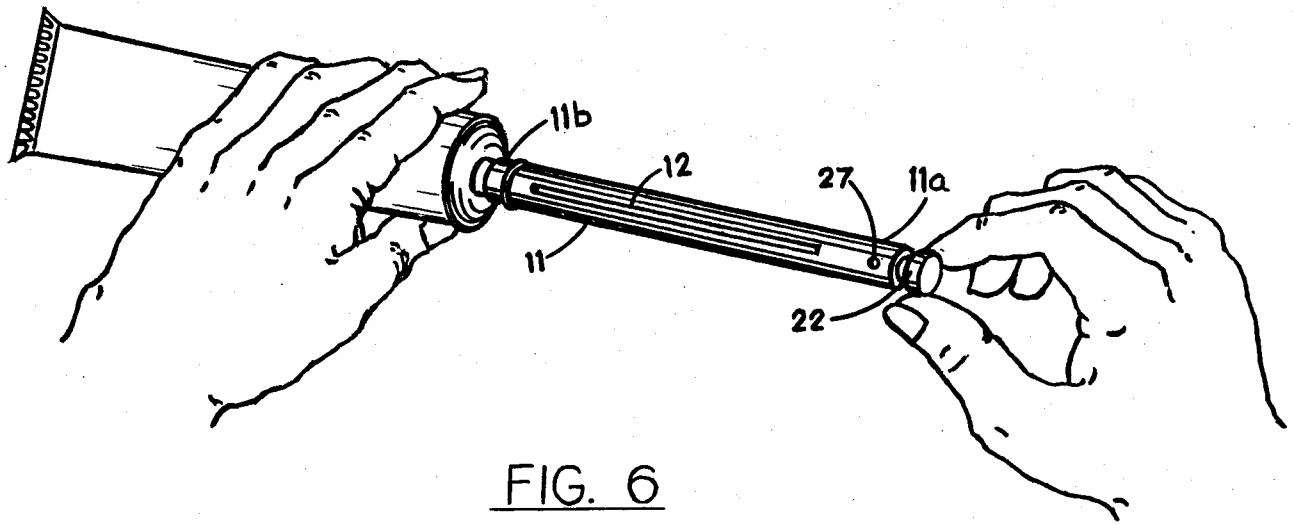
FIG. 6 is a reduced perspective view of the device as it is being loaded with paste.

As can be seen in FIGS. 2 and 6, the chamber (16) of the handle (11) is loaded with toothpaste in the following manner: First, the plunger (24) is completely retracted. Then, a tube of toothpaste is tightened into the threads (17), the contents of the tube being dispensed within the chamber (16). In some cases, it may be preferable to rotate the thumb-screw (22), and thereby retract the plunger (24), as the paste is loaded into the chamber (16) to assist in the loading operation. It should be noted at this point that an air hole (27) is drilled through the wall of the handle (11) near its closed ends (11*a*), to allow for the equalization of air pressure within the chamber (16). The hole (27) is located a distance from the closed end (11*a*) slightly greater than the thickness of the plunger (24). A compressible seal (28) is affixed to the circumference of the plunger (24) so that paste will not escape around it.

The bristle portion (30) of the device (10), tapers from the base (30*b*) of an exteriorly threaded end (30*a*), to the bristles (33), and is canted upwardly at a slight angle from the longitudinal axis of the handle (11) for more effective use. Within the bristle portion (30) is a passageway (16*a*) which serves to communicate between the open end (11*b*) of the handle (11) and a dispensing opening (32) adjacent the bristles (33). Tufts of bristles (33) surround the opening (32) (seen in FIG. 1) and are fastened to the bristle portion (30) in a manner known in the art.

A slidable gate (34) with a length and width slightly greater than the dimensions of the dispensing opening (32), may be adjustably retracted from covering the opening (32) by sliding it along guides (36) into a pocket (37). Each guide (36) projects slightly from the interior side walls of the bristle portion (30) along each longitudinal side of the opening (32). The pocket (37) is formed between the bristles (33) and the base (30*b*) of the threaded end (30*a*) by walling in the area between the guides (36), the wall (36*a*) forming the upper side of the passageway (16*a*) in the bristle portion (30). The pocket (37) has a slot (37*a*) in its upper surface, extending from adjacent the bristles (33) a length approximately equal to that of the dispensing opening (32). A T-shaped tab (38) is affixed to the gate (34), with the shank of the "T" passing through the slot (37*a*), and the top of the "T" overlapping each side of the slot (37*a*) for hand manipulation thereof.

The gate (34) is able to flex sufficiently so as to be able to follow the bend between the guides (36) and the pocket (37). Obviously, an embodiment of the invention wherein the bristle portion (30) is not canted will not require such ability to flex. Thus, the toothpaste is sealed from air and water by sliding gate (34) to the closed position shown in FIG. 2. The gate (34) may be opened slightly to allow only a small amount of paste to dispense, or opened to any extent, by sliding the tab (38) to the desired position.

Although the invention has been described as a complete unit, the manner in which the bristle portion (30) corresponds with the handle (11) makes sales of either individual portion possible. Thus, a toothpaste manufacturer may sell a disposable handle (11) filled with its specific brand of paste, ready to be tightened into any bristle portion (30), upon the removal of a screw top cap. In a similar vein, if different bristle hardnesses are desired, it would only be necessary to purchase a bristle portion (30) rather than a whole new brush, for use on a single handle (11).

Referring now to both FIGS. 1 and 2, the handle (11) is formed with an annular projecting lip (39) near its threaded end (11*b*). This lip (39) corresponds with a recess (not shown) with a cover (41) for snapping the cover (41) in place upon the handle (11). The cover (41) is cylindrical in shape, and is canted near its open end to correspond with the angle of the bristle portion (30). The cover (41) is cylindrical in shape, and is canted near its open end to correspond with the angle of the bristle portion (30). The cover (41) has a pocket clip (42) thereon, for easier transportation of the device (10).

It will be readily understood that the particular disposition or arrangement or nature of the elements of the invention are not of the essence of the invention, and that many variations, substitutions, and modifications may be made in departure from the particular construction and characterization in the drawings and foregoing description, without departing from the true spirit of the invention. It is therefore to be understood that the invention should be limited only by the breadth and scope of the appended claims.

What is claimed is:

1. A toothbrush of the type having a hollow handle containing a supply of paste and a means for dispensing the paste directly from the handle to the bristle end, the improvement comprising:

the handle having an opening threaded to mate with the threads of a toothpaste container;

a bristle supporting portion having a passageway communicating from an end threaded to mate with the opening of said handle, to an opening adjacent the bristles;

wherein said dispensing means includes:

a plunger having a threaded aperture in its center, said plunger slidably disposed within said hollow handle upon a threaded shaft;

said threaded shaft rotatably projecting through an aperture in the closed end of said handle for hand-manipulated rotation;

a guide projecting along an interior wall of said handle, parallel to the shaft, said guide mating with a notch in the edge of said plunger, whereby said plunger is advanced within said handle when the shaft is turned and the plunger is thereby restrained from turning with the shaft;

said handle being further characterized as having a small air hole proximal to its closed end, whereby air pressure within said handle is equalized during the operation thereof; and wherein said handle has a transparent portion extending substantially along its length and projecting slightly inwards, and wherein said transparent portion serves as the guide for said plunger.

2. The toothbrush as set forth in claim 1, wherein said bristle portion has a longitudinal slot approximately equal in length to that of the bristle-adjacent opening, located between the bristles, and the threaded end of said bristle portion, and further comprising:

gate guides extending along the longitudinal sides of the slot and bristle-adjacent opening;

a gate for sliding within said guides, of a length slightly greater than that of the bristle-adjacent opening;

a tab for manipulating said gate and affixed to its end proximal to the threaded end of the bristle portion; and, means for walling off the slot and guides from that portion of the passageway which surrounds the slot on all sides except that side which is proximal the bristle-adjacent opening.

3. The toothbrush as set forth in claim 2, wherein the bristle portion is canted upwardly with respect to the open end of the handle, and wherein the gate is of flexible material.

4. The toothbrush as set forth in claim 1 wherein said handle has a transparent portion near its open end, whereby the near depletion of paste therewithin can be indicated.

5. The toothbrush as set forth in claim 4 wherein said transparent portion extends substantially along the length of the handle.

6. The toothbrush as set forth in claim 1, further comprising:

an annular outwardly projecting lip near the open end of said handle; and a hollow cover of flexible material having an annular recess near its open end for mating with said annular lip on said handle.

* * * * *